United States Patent [19]

McQuillen, Jr. et al.

[11] Patent Number: 5,020,703

[45] Date of Patent: Jun. 4, 1991

[54] STATIONARY TOP PLATE FOR A SLIDING GATE VALVE AND METHOD OF MANUFACTURE THEREOF

[75] Inventors: Albert L. McQuillen, Jr., Pittsburgh, Pa.; Michael McQuillen, Crown Point, Ind.; Mark McQuillen, Pittsburgh, Pa.

[73] Assignee: Serusteel, Inc., Morgan, Pa.

[21] Appl. No.: 470,742

[22] Filed: Jan. 26, 1990

[51] Int. Cl.[5] ..... B22D 41/28

[52] U.S. Cl. ..... 222/590; 222/600

[58] Field of Search ..... 222/600, 590; 266/271

[56] References Cited

U.S. PATENT DOCUMENTS 4,508,324 4/1985 Lührsen et al. ..... 222/600

4,728,013 3/1988 Winkelmann et al. ..... 222/600

*Primary Examiner*—S. Kastler

*Attorney, Agent, or Firm*—Rogers & Killeen

[57] ABSTRACT

A rigid carbon steel band may be used in a stationary top plate for a sliding gate valve and in the manufacture thereof. The refractory material in a stationary top plate may be compressibly held by a steel band having sufficient rigidity and size to prevent cracking of the refractory material during handling and use, and having sufficient length to allow the band's distal ends to be welded end-to-end. The welded band may be heat processed to set the size of the band and maintain the desired amount of refractory compression. The thickness of the plate of refractory material may be the same adjacent the aperture for the teeming metal and at the periphery of the plate.

6 Claims, 1 Drawing Sheet

STATIONARY TOP PLATE FOR A SLIDING GATE VALVE AND METHOD OF MANUFACTURE THEREOF

BACKGROUND OF THE INVENTION

The present invention relates to a stationary top plate in a sliding gate valve for controlling the discharge of molten metal from a metallurgical vessel, and to a method of manufacturing the stationary top plate.

Sliding gate valves are well-known and in widespread use. Such valves generally comprise a frame secured to the vessel, a hydraulically reciprocated carrier slidably disposed in the frame, and a movable bottom plate such as an apertured nozzle or reciprocating gate refractory member carried by the carrier into and out of registration with an apertured stationary top plate mounted on the well block nozzle of the vessel. A number of springs positioned around the aperture are generally used to hold the stationary top plate and movable bottom plate in pressural engagement during the relative reciprocation.

During use of the valve, the abutting surfaces of the two plates in the area of their respective discharge openings may become damaged due to corrosion and/or erosion by the molten metal. This causes the discharge openings to be enlarged to an undesirable degree during continued use of the valve. As a result, the stationary and movable plates can be used for only a few discharge operations, after which they must be discarded or repaired. The plates may also fracture due to thermal and mechanical stress encountered during use. Valves of this type are disclosed, for example, in the Shapland, et al. U.S. Pat. No. 4,063,668 dated Dec. 20, 1977.

As described, for example, in the Shapland, et al. patent, a two-piece well block is provided at the central portion of the refractory lining of the vessel and has a working nozzle positioned centrally thereof which extends through the bottom portion of the vessel. The working nozzle generally includes an annular ridge extending downwardly around the teeming opening. The stationary top plate of the sliding gate valve generally contains an annular groove around the teeming opening proportioned to receive the annular ring of the working nozzle, and thereby provide a labyrinth seal.

As used herein, a "labyrinth seal" is one in which the potential leakage path is lengthened, and in which abrupt changes in direction of flow are required, all to increase the likelihood of freezing the metal before it can reach the exterior of the refractory.

As disclosed in the Shapland, et al. patent, a metal enclosure surrounds the periphery of the stationary top plate and extends over a portion of the top surface nearest the vessel. The metal enclosure protects the refractory material during handling and use and may be reused after the enclosed refractory material is no longer useful.

There are a number of problems associated with the metal enclosure of the top plate. The repair and refilling of the metal enclosure is an expensive operation normally accomplished at a facility separate from the user. Such a procedure requires the development of supply lines and stock piles commensurate with the time to repair and refill the metal enclosures.

Another disadvantage is that if molten metal should penetrate the labyrinth seal and come into contact with the metal enclosure of the top plate, that metal will immediately liquify and produce a gap between the refractory of the stationary top plate and that of the well block nozzle. Molten metal from the vessel under the ferrostatic head can escape into the outside environment through such gaps with disastrous results.

A further disadvantage of the metal enclosed refractory top plate of the Shapland, et al. patent is that the thickness of the metal enclosure requires a reduction in the thickness of the refractory. This results in reduced heat distribution characteristics, greater susceptibility to fracture due to thermal stress, and less leak-preventing cooling of the metal by the refractory.

Additionally, the relative thinness of the refractory limits the depth of the labyrinth seal formed between the well block nozzle and the top surface of the refractory top plate and thus limits its effectiveness as a seal. To improve the effectiveness of the seal, groove depth may be increased, but this increases the likelihood of fracture of the plate material because the distance between the bottom of the groove and the lower working surface is reduced.

These problems have encouraged the use of a metal ring about the periphery of the plate of refractory material in the stationary top plate, without the metal encased top surface as suggested by Shapland, et al.

It is known to place the ring about the refractory plate after the plate is in place in the top plate assembly. During shipping and handling, however, the plate of refractory material may crack because it is not being compressibly held. See, for example, U.S. Pat. No. 4,763,881 to Wenger, in which a flexible ring is secured about the refractory plate with a complex and time-consuming tightening procedure.

The ring may also be secured to the refractory with mortar. If such a ring is to be reused, the mortar must be removed using special procedures that entail added cost and time and thus does not decrease the supply lines and stockpiles. In U.S. Pat. No. 4,566,925 to Schuabel, et al., for example, the mortar is used with the additional step of heat-shrinking the metal ring.

The ring may also be stretched past its elastic limit and permanently deformed. The inherent spring characteristics of the metal and the rigidity of the refractory require a precise deformation in order to establish the desired degree of refractory compressibility without damage to the refractory. Obviously, such a ring cannot be reused. In U.S. Pat. No. 4,627,147 to Kagi, for example, the ring is compressed into an evacuated plate concavity that reduces the amount of leak-preventing refractory.

See also U.S. Pat. Nos. 4,702,460 to Muschner and 4,728,013 to Winkelmann, et al. that allude to, but do not specifically describe such rings.

To be effective and practical for a user, the ring should desirably be thick enough and wide enough to have sufficient rigidity to inhibit cracking of the refractory during handling and use. If should also comprise materials, such as carbon steel, that is amenable to reuse. It should have a simple design and strength so that repair and refill is quickly accomplished, thereby reducing the supply lines and stockpiles. The ring should be easily manufactured, such as by welding the distal ends of the ring end-to-end (i.e., butt welding).

It is accordingly an object of the present invention to obviate many of the problems of prior art stationary top plates and to provide an improved stationary top plate for use in gate valves such as disclosed in the Shapland, et al. patent.

It is a another object of the present invention to provide an improved stationary top plate having a greater useful life by increasing the overall thickness of the refractory material.

It is a further object of the present invention to provide an improved stationary top plate with improved structural integrity.

It is still another object of the present invention to provide a band for a refractory plate that has sufficient width and thickness to inhibit cracking of the refractory during handling and use and that is easy to manufacture.

It is a further object of the invention to provide an improved refractory plate having means around the periphery thereof for retaining the refractory plate in place in the event of a fracture, which means is easily installed and accurately set as to compressive force.

These and many other objects, features, and advantages of the invention will be apparent from the claims and from the following detailed description of a preferred embodiment thereof, with reference to the accompanying drawings.

THE DRAWINGS

DETAILED DESCRIPTION

The stationary top plate of the present invention is adapted for use in conjunction with a sliding gate valve such as described in Shapland, et al., U.S. Pat. No. 4,063,668, and the disclosure of that patent is incorporated herein by reference. The stationary top plate of the present invention may be inserted and removed and/or reversed for reuse in a gate valve such as therein disclosed.

Figure 1:
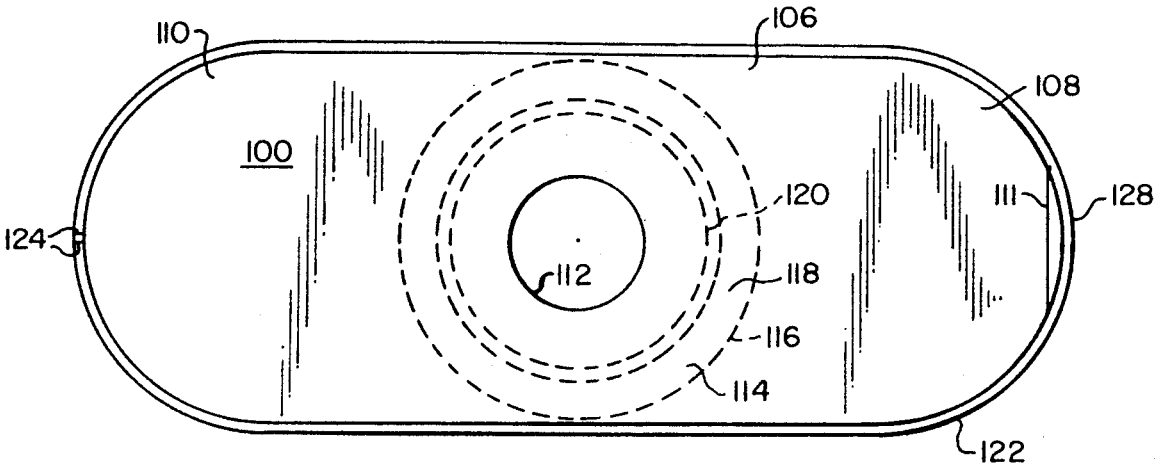
FIG. 1 is a top plan view of the stationary top plate of the present invention showing the metal band surrounding the plate.

With reference to the drawings, the top plate includes a plate of refractory material 100 having parallel opposite planar surfaces 102 and 104, and, as shown in FIG. 1, an elongated oval or ob-round configuration comprising an apertured central rectangular portion 106 and two semicircular end portions 108 and 110. One end portion may include a flattened section 111.

Figure 2:
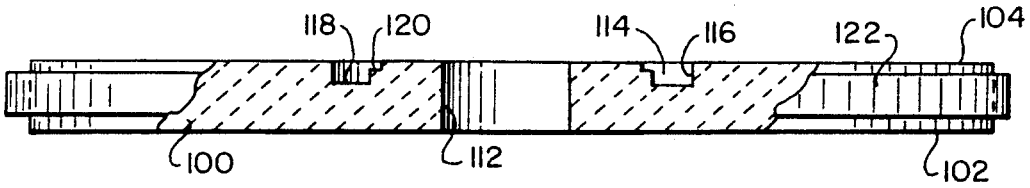
FIG. 2 is a side view in partial section of the stationary top plate of FIG. 1.
Figure 3:
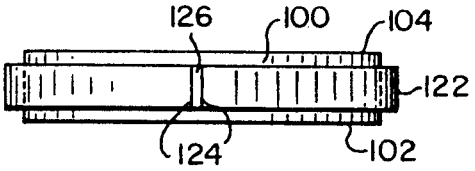
FIG. 3 is an end view of the stationary top plate of FIG. 1.

A circular teeming opening 112 is centered bilaterally with respect to the length and width of the plate 100. As may be seen more clearly in FIG. 2, a depressed annular groove 114 concentric with the discharge opening 112 surrounds the discharge opening 112 on the top surface 104. The annular groove 114 comprises a substantially vertical radially outer wall 116, a base 118, and a stepped radially inner wall 120. In contrast to the prior art, the height of the radially outer wall 116 is approximately the same as the total height of the stepped radially inner wall 120.

The specific configuration of the depressed annular groove 114 enables a well block nozzle such as the nozzle of the Shapland, et al., patent to be seated in the groove so that molten steel coursing through the discharge opening 112 must traverse an elongated path with several changes of direction to penetrate the seal between the well block nozzle and the upper surface of the top plate. By increasing the thickness of the refractory material at the outer wall of the groove, the path formed by the labyrinth seal is lengthened without decreasing the distance between base 118 and lower plate surface 102.

The plate of refractory material 100 is one integral casting which, in a preferred embodiment, has a ratio of thickness to width to length of 1:6.2:15.8. In a preferred embodiment, the thickness of the plate of refractory material may be about 1.6 inches (±0.05 inches), and the distance between the lower parallel surface 102 of the plate 100 and the base 118 of the depressed annular groove may be approximately 70% the thickness of the plate.

The plate 100 has a metal band 122 surrounding the periphery of the plate. The band 122 is desirably sufficiently rigid to prevent cracking of the refractory material in the plate 100 during handling and use. To this end, the band 122 may have a width between about one-half and three-quarters the thickness of the refractory plate, with a width five-eights of the thickness preferred, and a thickness about 3/16 of the band's width. In the embodiment used in the Shapland, et al. valve, the band may be 1 inch wide and 3/16 inch thick. The band desirably comprises a material amenable to reuse, such as carbon steel or the like.

For ease of manufacture, the distal ends 124 of band 122 may be butt welded. The butt weld 126 may have substantially the same width and thickness as the band 122 so that the outside perimeter 128 of the welded band is smooth, that is, without a ridge extending beyond the outside perimeter 128 of the band 122.

During manufacture, the band 122, may be shaped generally to conform to the periphery of the plate 100 and the distal ends 124 may be butt welded. The welded band may then be heated to cause it to expand so that the heated band may be positioned around the plate of refractory material. After being so positioned without the use of mortar, the welded band may be cooled so that the band shrinks to compress the refractory material.

After the enclosed refractory material is no longer useful and the weld is still sound, the band may be repaired by removing any remaining refractory residue from the inside of the band. The smooth and simple shape of the band reduces the time for this procedure from that of the conventional metal enclosure. The band may then be reused. If the weld is not sound, the band may be discarded or repaired by rewelding.

Although particular embodiments of the invention have been shown and described in full here, there is no intention to thereby limit the invention to the details of such embodiments. To the contrary, the intention is to cover all modifications, alternatives, embodiments, usages, and equivalents which fall within the spirit and scope of the invention as defined in the appended claims.

We claim:

1. A stationary top plate for a sliding gate valve for controlling the discharge of molten metal from a metallurgical vessel comprising:

an apertured plate of refractory material having:

a lower planar surface adapted to slidingly contact a surface of a movable plate in said gate valve, and an upper surface parallel to and approximately one and six-tenths inches spaced apart from said lower surface, said upper surface being provided with an annular groove adapted to mate with an annular ring on the well block nozzle of the vessel; and a rigid carbon steel band surrounding the periphery of said plate of refractory material intermediate said upper and lower surfaces for maintaining said plate of refractory material under compression, said band having a width of approximately one inch and a thickness of approximately three-sixteenths of an inch to achieve rigidity sufficient to inhibit cracking of said plate during handling and use, and a length such that the distal ends of said band are sufficiently close when said band surrounds said plate to allow said ends to be butt welded.

2. The top plate as defined in claim 1 wherein the height of the radially outward edge of said annular groove is approximately equal to the total height of the radially inward edge of said annular groove.

3. In a stationary top plate for a sliding gate valve for controlling the discharge of molten metal from a metallurgical vessel, said top plate having a plate of refractory material with an aperture therethrough and a lower planar surface spaced apart from an upper surface, the improvement comprising:

said upper surface being spaced a first distance apart from said lower surface adjacent said aperture and at the periphery of said top plate; and a rigid carbon steel band surrounding the periphery of said plate of refractory material intermediate said upper and lower surfaces for maintaining said plate of refractory material under compression, said band having a width about five-eights said first distance and a thickness about three-sixteenths said width to achieve rigidity sufficient to inhibit cracking of said plate of refractory material during handling and use, and a length such that the distal ends of said band are sufficiently close when said band surrounds said plate to butt weld said distal ends, said ends being butt welded so that the width and thickness of said butt weld corresponds to the width and thickness of said band.

4. A method of manufacturing a stationary top plate for a sliding gate valve comprising the steps of:

(a) providing a plate of refractory material having a lower planar surface adopted to slidingly contact a surface of a moveable refractory plate in a sliding gate valve and an upper surface parallel to and spaced a first distance apart from said lower surface, said upper surface being provided with an annular groove adapted to mate with an annular ring on the well block nozzle of the metallurgical vessel to which the sliding gate valve may be attached;

(b) forming a carbon steel band so that said band may be positioned around the periphery of said plate of refractory material intermediate said upper and lower surfaces and so that the distal ends of said band do not overlap and are close enough to allow said ends to be butt welded, said band having a width that is about five-eights said first distance and a thickness that is about three-sixteenths said width;

(c) butt welding said distal ends of said band so that the outside perimeter of said band is generally smooth;

(d) heating said welded band so that the heated band may be positioned around said plate of refractory material;

(e) positioning the heated band around said plate of refractory material; and (f) cooling the positioned band so that said refractory material is under compression.

5. The method as defined in claim 4 wherein said heated band is positioned around said plate of refractory material without mortar therebetween.

6. The top plate as defined in claim 3 wherein said steel band surrounds the periphery of said plate without mortar therebetween.

* * * * *